US012523217B1

(12) United States Patent
Feliciano et al.

(10) Patent No.: US 12,523,217 B1
(45) Date of Patent: Jan. 13, 2026

(54) PINCHING CONTROL OF PERISTALTIC PUMPS

(71) Applicant: L'Oreal, Paris (FR)

(72) Inventors: Rafael Feliciano, New Providence, NJ (US); Grégoire Charraud, Jersey City, NJ (US); Juwan Hong, Jersey City, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 18/930,517

(22) Filed: Oct. 29, 2024

(51) Int. Cl.
*F04B 49/02* (2006.01)
*F04B 43/12* (2006.01)
*F04B 49/06* (2006.01)

(52) U.S. Cl.
CPC ..... *F04B 49/02* (2013.01); *F04B 43/12* (2013.01); *F04B 49/065* (2013.01); *F04B 2203/0213* (2013.01)

(58) Field of Classification Search
CPC ..... F04B 49/02; F04B 43/12; F04B 49/065; F04B 2203/0213; F04B 43/1253; F04B 43/1276; A61M 60/279
See application file for complete search history.

(56) References Cited

U.S. PATENT DOCUMENTS

| | | | | |
|---|---|---|---|---|
| 4,165,954 | A * | 8/1979 | Amos | F04B 43/1253 417/477.11 |
| 4,910,682 | A * | 3/1990 | Wolff | G05D 7/0676 700/282 |
| 5,125,801 | A * | 6/1992 | Nabity | G01F 3/20 417/63 |
| 8,393,880 | B2 * | 3/2013 | Vidal | F04B 43/1276 417/477.3 |
| 11,014,697 | B2 * | 5/2021 | Cichy | F04B 43/1284 |
| 11,484,016 | B2 * | 11/2022 | Lindenmoyer | A01K 63/047 |
| 2004/0096347 | A1 * | 5/2004 | Pelmulder | F04B 43/1238 417/476 |
| 2025/0144278 | A1 * | 5/2025 | Tsoory | A61M 1/1524 |

* cited by examiner

*Primary Examiner* — Jesse S Bogue
(74) *Attorney, Agent, or Firm* — CHRISTENSEN O'CONNOR JOHNSON KINDNESS PLLC

(57) ABSTRACT

A method of prolonging the life of a peristaltic pump, including setting a timer for a predetermined rest time after the peristaltic pump is used, transmitting a micro pulse to a motor of the peristaltic pump after the predetermined rest time has elapsed, and shifting a motor roller from an initial position to a second position so that a pinch point of a tube of the peristaltic pump is formed in the second position. Further, a non-transitory computer readable storage medium storing instructions that cause the one or more computers to set a timer for a predetermined rest time after the peristaltic pump is used, transmit a micro pulse to a motor after the predetermined rest time has elapsed. and shift a motor roller from an initial position to a second position so that a pinch point of a tube of the peristaltic pump is formed in the second position.

20 Claims, 4 Drawing Sheets

PINCHING CONTROL OF PERISTALTIC PUMPS

SUMMARY

In one aspect, disclosed herein is a method of prolonging the life of a peristaltic pump, the method including setting a timer for a predetermined rest time after the peristaltic pump is used, transmitting a micro pulse to a motor of the peristaltic pump after the predetermined rest time has elapsed, and shifting a motor roller from an initial position to a second position so that a pinch point of a tube of the peristaltic pump is formed in the second position.

In some embodiments, the predetermined rest time is about 12 hours.

In some embodiments, the second position is offset at an angle relative to the initial position. In some embodiments, the angle is about 30 degrees.

In some embodiments, the method further includes resetting a second timer for a rotation time a predetermined number of times, transmitting a micro pulse of a plurality of micro pulses to the motor each time the rotation time elapses, and shifting the motor roller to a new position so that a pinch point of the tube of the peristaltic pump is formed in the new position each time the micro pulse of the plurality of micro pulses is received by the motor.

In some embodiments, the method further includes setting a second timer for a rotation time, after the rotation time has elapsed, transmitting a second micro pulse to the motor, and shifting the motor roller from the second position to a third position so that a pinch point of the tube of the peristaltic pump is formed in the third position.

In some embodiments, the third position is offset at an angle relative to the second position. In some embodiments, the angle is about 30 degrees.

In some embodiments, the method further includes resetting the second timer a predetermined number of times, transmitting a micro pulse of a plurality of micro pulses to the motor each time the rotation time elapses, and shifting the motor roller from the third position to a new position so that a pinch point of the tube of the peristaltic pump is formed in the new position each time the micro pulse of the plurality of micro pulses is received by the motor.

In some embodiments, the peristaltic pump is integrated into a device. In some embodiments, the micro pulse is transmitted by a controller of the device.

In another aspect, disclosed herein is a non-transitory computer readable storage medium storing instructions that, when executed by one or more computers, cause the one or more computers to set a timer for a predetermined rest time after the peristaltic pump is used, transmit a micro pulse to a motor of the peristaltic pump after the predetermined rest time has elapsed, and shift a motor roller from an initial position to a second position so that a pinch point of a tube of the peristaltic pump is formed in the second position.

In some embodiments, the predetermined rest time is about 12 hours. In some embodiments, the second position is offset at an angle relative to the initial position. In some embodiments, the angle is about 30 degrees.

In some embodiments, the instructions are further configured to set a second timer for a rotation time, transmit a second micro pulse to the motor after the rotation time has elapsed, and shift the motor roller from the second position to a third position so that a pinch point of the tube of the peristaltic pump is formed in the third position. In some embodiments, the third position is offset at an angle relative to the second position. In some embodiments, the angle is about 30 degrees.

In some embodiments, the instructions are further configured to reset the second timer a predetermined number of times, transmit a micro pulse of a plurality of micro pulses to the motor each time the rotation time elapses, and shift the motor roller from the third position to a new position so that a pinch point of the tube of the peristaltic pump is formed in the new position each time the micro pulse of the plurality of micro pulses is received by the motor.

In some embodiments, the peristaltic pump is integrated into a device, and the micro pulse is transmitted by a controller of the device.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Figure 1A:
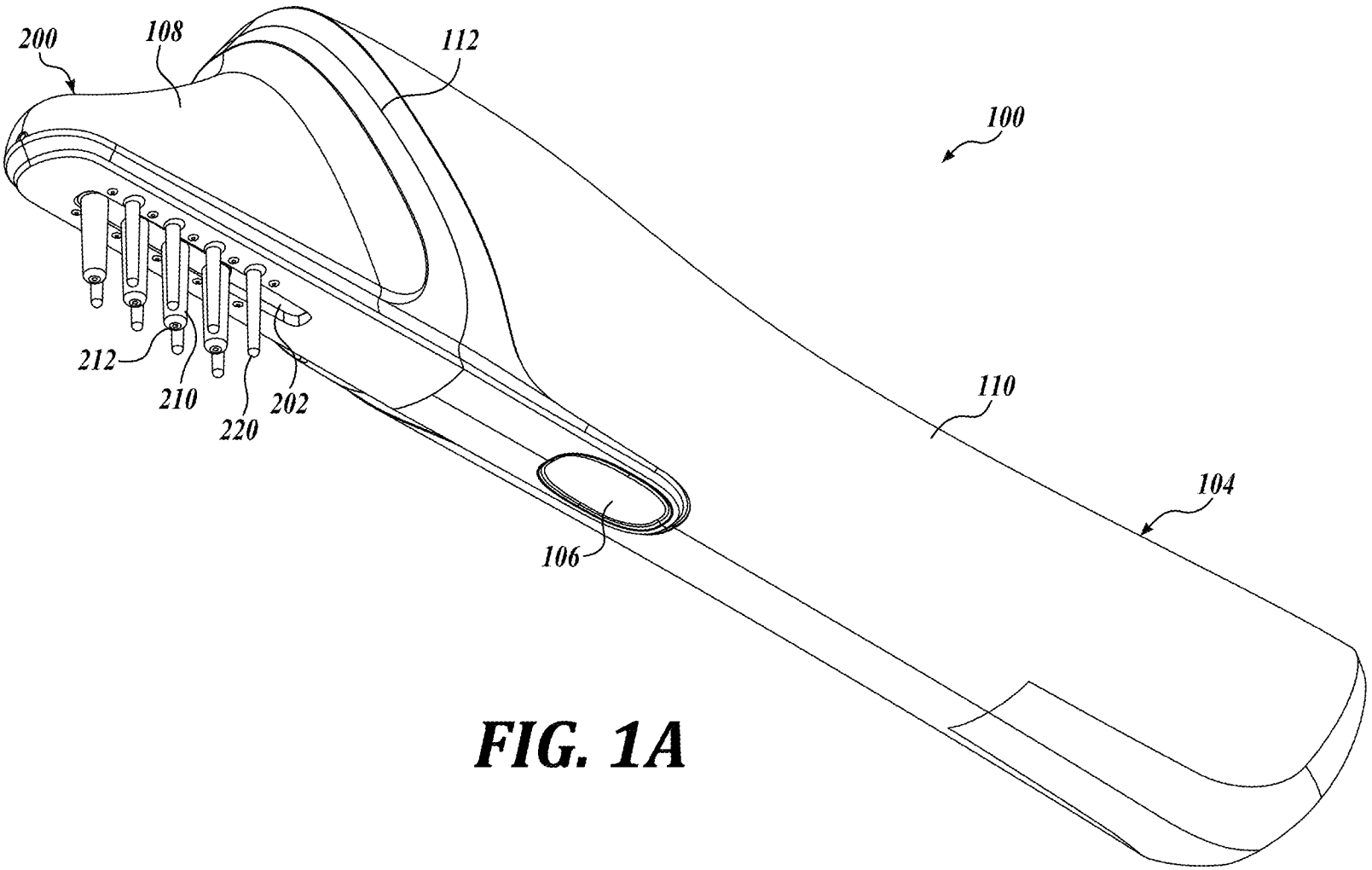
FIG. 1A is a perspective view of an example device having a peristaltic pump, in accordance with the present technology.

The foregoing aspects and many of the attendant advantages of this invention will become more readily appreciated as the same become better understood by reference to the following detailed description, when taken in conjunction with the accompanying drawings.

DETAILED DESCRIPTION

The following description provides several examples that relate generally to the health and life of peristaltic pumps. In some embodiments, the peristaltic pumps are incorporated into a device, such as a hair coloring device.

In some embodiments, the device is configured to apply treatment formulation to targeted areas of the hair and scalp tissue. Examples of treatment formulations applied by the embodiments herein include: permanent hair dye; semi-permanent hair dye; developer; conditioner; hair growth treatment, such as minoxidil manufactured under the trade name ROGAINE®; hair protein treatment; disulfide bond repairing hair treatment, such as OLAPLEX®; fluid hair treatment; fluid scalp treatment, and the like. Although any hair and scalp treatment formulation is suitably applied using the embodiments of the appliance described herein, the present disclosure generally refers to hair coloring formulation as the example of treatment formulation applied by the appliance described below. However, it should be appreciated that any of the listed hair and scalp treatment formulations are interchangeable with the coloring formulation described herein.

Targeted coloring of the roots of the hair, such as during a maintenance procedure for previously colored hair, generally includes application of coloring formulation to hair segments near the scalp. To achieve the desired result of blending the segments of natural colored hair near the scalp with the previously colored hair, the coloring formulation generally should be applied to only the roots, requiring a precise delivery of coloring formulation.

Hair coloring formulation typically includes at least one dye and a separate developer, which must be mixed in controlled proportions for effective and predictable results. As used herein, the term "coloring formulation" (or CF) refers generally to any of the dye, developer, formulation, fluid, or any mixture thereof.

In conventional peristaltic pumps, formula flows from one end of a formula delivery tube of a peristaltic to pump to the other end, to eventually be dispensed by the device. The peristaltic pump may include one or more motor rollers configured to pinch the formula delivery tube when the device is not in use to prevent leakage, dripping, or the like. The motor roller may also pinch the formula delivery tube while the device is stored. Constant compression of the formula delivery tube in peristaltic pumps can lead to excessive creep, particularly in silicone tubing, which can lead to permanent deformation or fusing of the inner diameter of the tubing.

Accordingly, the following provides examples of methods and software for prolonging the life of peristaltic pumps by ensuring that a pinch point of a tube of the peristaltic pump does not experience creep or tube fusing when the device remains unused. In some embodiments, the motor receives one or more micro pulses from a controller, such as a controller of the device, that directs the motor to shift a motor roller to a new location along a formula delivery tube. In some embodiments, the first micro pulse is transmitted after a predetermined time after a use of the device. In some embodiments, the predetermined time is about 12 hours. This may ensure that the micro pulse is sent during the night, when the device is not in use. In such embodiments, the motor roller can be shifted without interrupting normal use of the device. After the first micro pulse, additional micro pulses may be transmitted each time a rotation time (via a second timer) elapses. In some embodiments, the rotation time is 24 hours, which also may ensure that the micro pulse is sent during the night, when the device is not in use. In this manner, even if the device is not used for an extended period of time, the motor roller shifts along the formulation delivery tube, thereby reducing or eliminating creep and tube fusing.

FIG. 1A is a perspective view of an example device having a peristaltic pump, in accordance with the present technology. The formula delivery device 100 is shown in use with a plurality of nozzles for implementing one or more methodologies or technologies such as, for example, applying a coloring formulation to the hair and/or scalp tissue of a user. For example, some coloring formulations have improved results when applied to a targeted area of the hair of the user, such as when treating the root segments of the hair, as described above. However, as also discussed above, conventional hair coloring kits are generally configured for manual mixing and application of the coloring formulation, a method of which is time consuming and not well-suited for consistent, desired results. In addition, results obtained from conventional hair coloring kits are often highly technique-dependent, requiring training and familiarity with the process for the desired results.

By use of the embodiments of the present disclosure, coloring formulation may be applied to portions of the hair in a way that would be difficult to accomplish with direct application of the coloring formulation alone. Embodiments of the present disclosure are also suitable for applying a treatment formulation to any surface of the body of the user or any other suitable surface.

Although the formula delivery device 100 and the other exemplary embodiments are described and illustrated as being used with a plurality of nozzles, it should be appreciated that the formula delivery devices shown and described herein may be used with any suitable formulation applicator configuration and for any suitable use.

The formula delivery device 100 is shown as an appliance having a handle assembly 104 and a consumable assembly 200. In this regard, the formula delivery device 100 will be referred to hereinafter as an appliance 100. The handle assembly 104 includes a handle shell 110, and a control button 106. The handle shell 110 provides a surface for a user to grasp with a hand while using the appliance 100. In this regard, the handle shell 110 is ergonomically shaped in the illustrated embodiments. However, in other embodiments, the handle shell 110 is suitably any shape to contain the internal components and provide one or more gripping surfaces for the user. In further embodiments, the consumable assembly 200 may form at least part of the gripping surfaces for the user.

The handle shell 110 houses various appliance control components, such as one or more of a drive motor having a drive gear (see FIG. 1B), a CPU, a battery, a communications system (such as wireless networking (Wi-Fi), Radio Frequency Identification (RFID), Near Field Communication (NFC), BLUETOOTH®, and the like), an electric and data connector at a port (such as Universal Serial Bus (USB), Firewire, or the like), temperature sensors, accelerometers, fluid sensors, data scanners, light sources, audible signal generator, fluid heating sources, temperature controllers, and other suitable control components, which are not shown for simplicity. In some embodiments, the port is suitably used to provide an interface between the internal control components of the appliance 100 and external components/systems, and/or charge the battery of the appliance 100.

The control button 106 may be configured for the activating, deactivating, and controlling features of the appliance 100. In some embodiments, pressing the control button 106 powers on the appliance 100 such that coloring formulation CF is drawn from the formulation containers (see FIG. 1B). In these embodiments, releasing the control button 106 may stop the flow of coloring formulation CF. In certain examples, the control button 106 may be used to initialize the appliance 100 or place the appliance 100 in a state to perform certain functions, such as one or more of: calculating a mixture ratio of the components of the coloring formulation CF; entering a cleaning or purging mode; heating the formulation; gathering data from the formulation containers, such as volume remaining, mixture ratios, color information, etc.; sending and receiving signals through the port; analyzing data regarding user preferences; gathering data from sensors; providing status indication to the user, such as power output level, battery life, formulation volume remaining, sensor data, data connection information, etc.; and communicating with auxiliary equipment. In some embodiments, the control button 106 is capable of pressure sensitive operation, such that applying a higher pressure to the control button 106 causes a variable response, such as, for example, causing the formulation to flow faster, the nozzles to move faster, or the like. In some embodiments, various operating parameters can be controlled by the use of a smart device, such as a phone (as described in detail in U.S. patent application Ser. No. 14/586,138, which is incorporated by reference herein).

Figure 1B:
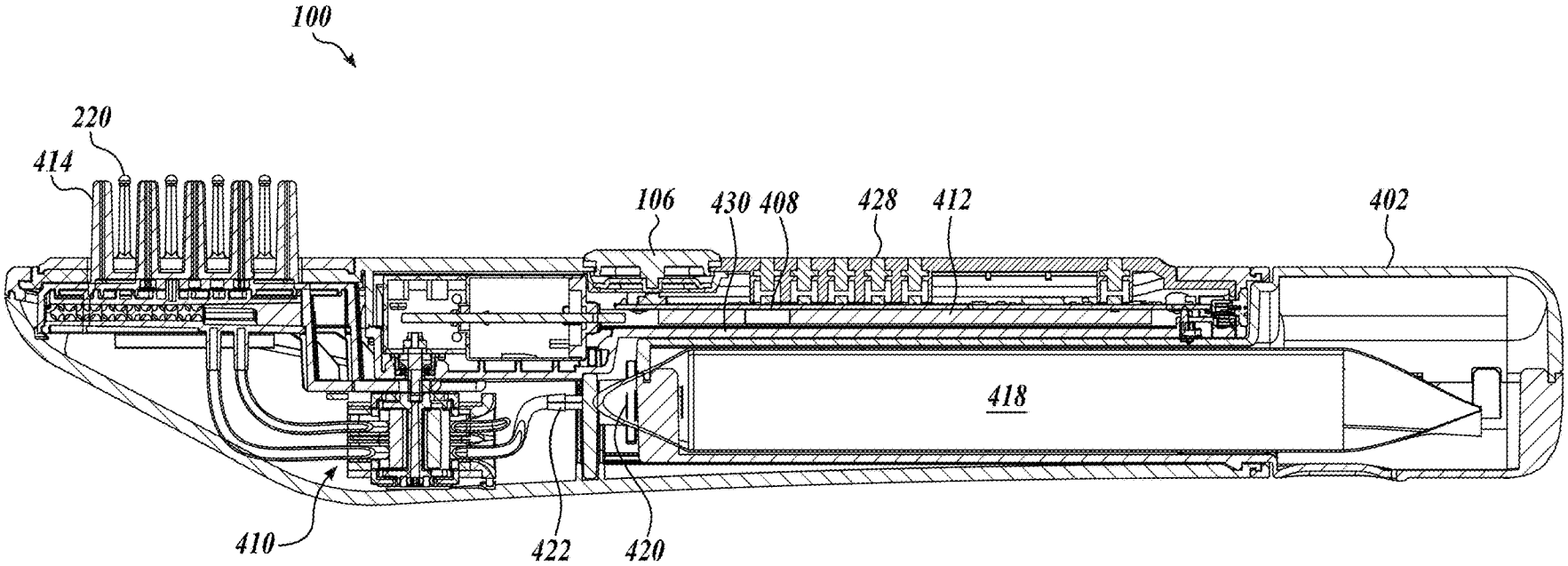
FIG. 1B is a cross-section of the example device of FIG. 1A, in accordance with the present technology.

The consumable assembly 200 will now be described in greater detail. The consumable assembly 200 generally includes a head cover 108 to house and enclose various components of the consumable assembly 200, which will be described in greater detail below. The output area of the head cover 108 includes a plurality of elongate nozzles 210 extending from a manifold housing 202 coupled to or formed on the head cover 108. The elongate nozzles 210 are configured to discharge the coloring formulation CF through a plurality of outlet apertures 212 in the end of the nozzle 210 upon use of the appliance 100. In some embodiments, the nozzles 210 are arranged in one or more rows along the length of the head cover 108, generally in a direction along the length of the appliance 100, as shown in FIG. 1A-1B. In other embodiments, the nozzles 210 are suitably placed at an angle with respect to the length of the appliance 100.

In some embodiments, the nozzles 210 have a length between about 0.5 cm and about 4.0 cm from the manifold housing 202 to the end of the nozzles 210 at the outlet apertures 212. In other embodiments, the nozzles 210 have a length between about 1.4 cm and about 1.8 cm from the manifold housing 202 to the end of the nozzles 210 at the outlet apertures 212. In other embodiments, the nozzles 210 have a length of about 1.6 cm from the manifold housing 202 to the end of the nozzles 210 at the outlet apertures 212. In further embodiments, any length of nozzle is suitably used.

In the illustrated embodiment, a plurality of standoff protrusions 220 extend outwardly substantially in the direction of the nozzles 210 from the head cover 108 in one or more rows. In this regard, substantially in the direction of the nozzles 210 is intended to refer to within and angle of about 25 degrees of the direction along the length of the nozzles 210. In the depicted embodiment, first and second rows of protrusions 220 are positioned along each side of a single row of elongate nozzles 210. In some embodiments, the standoff protrusions 220 may be disposed at an angle relative to the plurality of nozzles 210.

In some embodiments, each of the standoff protrusions 220 has a length (measuring between the head cover 108 to an end of the standoff protrusion 220) such that the end of the standoff protrusion 220 and the outlet apertures 212 of the nozzles 210 is substantially coplanar. In other embodiments, the standoff protrusions 220 have a length (from the head cover 108 to the end of the standoff protrusion 220) such that the standoff protrusions 220 are longer than a length of the nozzles 210 (measuring between the head cover 108 to an end of the nozzles 210). In this regard, during use, the standoff protrusions 220 would contact an application surface, such as a localized portion of the scalp, and space the outlet aperture 212 of the nozzles 210 away from the application surface to provide a gap for discharge of the coloring formulation CF through the outlet aperture 212. In the embodiments where the standoff protrusions 220 are longer than the plurality of nozzles 210, the standoff protrusions 220 are between about 0.1 mm and 5.0 mm longer than the length of each of the plurality of nozzles 210. In other embodiments, the standoff protrusions 220 are between about 0.5 mm and 1.5 mm longer than the length of each of the plurality of nozzles 210. In other embodiments, the standoff protrusions 220 are about 1.0 mm longer than the length of each of the plurality of nozzles 210.

FIG. 1B is a cross-section of example device 100 of FIG. 1A, in accordance with the present technology. In some embodiments, the device 100 further includes a formulation cartridge 402 having one or more formulation vessels 418 (e.g., pouches or packets) disposed therein, each of which has an output nozzle 220 protruding through a distal (forward) end of the formulation cartridge 402 in a configuration that fluidically connects with a corresponding formulation inlet 422 of a peristaltic pump 410 when the formulation cartridge 402 is fully inserted into the cartridge cavity 424.

A button 106 disposed on the reusable handle 406 and electrically connected to the controller 412 activates features of the formulation delivery device 400 described above. In some embodiments, depressing the button 106 activates the features of any of the modules described herein. For example, in some embodiments, pressing button 106 activates a sleep/awake module stored in controller 412, thereby awakening formulation delivery device 400 from a sleep state to an awake state. In some embodiments, pressing button 106 while a formulation cartridge is inserted into the reusable handle 406 activates a formulation routine module stored in controller 412, thereby initiating a formulation routine.

In some embodiments, pressing button 106 while a cleaning cartridge is inserted into the reusable handle 406 activates a cleaning routine module stored in controller 412, thereby initiating a cleaning routine. Visual indicators 428 (e.g., LEDs) disposed along the reusable handle 406 indicate one or more of a remaining formulation quantity or a remaining battery life, e.g., based upon a dispensed time determined by the formulation routine module of the controller. Some embodiments include additional buttons and/or a different number of visual indicators 428 with different functionalities, and the illustrated embodiment is not limiting. In some embodiments, visual indicator 428 is a multi-segment LED with each segment corresponding to an equal proportion of the formulation remaining in the formulation cartridge.

Controller 412 comprises logic (stored in a data store thereof), which when executed by a processor of the controller 412, causes a cartridge authentication interface 430 disposed in the reusable handle 406 (e.g., an RFID reader) to read an encryption chip 432 on the formulation cartridge 402 in order to authenticate the formulation cartridge 402. The encryption chip 432 stores at least one of the formulation cartridges 402, a formulation identification, a beginning formulation quantity, a formulation expiration date, or a formulation production date.

Controller 412 also comprises logic, which when executed, causes the formulation delivery device to execute, based upon authenticating the formulation cartridge 402, a formulation routine that dispenses a mixed formulation (of the first formulation and the second formulation) from the formulation cartridge 402 through the formulation dispensing assembly. For example, the formulation delivery device authenticates the first and second formulations after (or upon) insertion of a formulation cartridge into the reusable handle, and then, in response to pressing a button on the reusable handle, executes a formulation routine which causes the peristaltic pump 410 to continuously or continually mix the first and second formulations, and to dispense the same from the reciprocating nozzle assembly at one or more of the following predetermined device operating parameters for as long as the button is depressed: a formulation flow rate, a reciprocating frequency, or a reciprocating amplitude.

In some embodiments, controller 412 also comprises logic, which when executed, causes the formulation delivery device to execute, based upon authenticating a cleaning cartridge inserted into the reusable handles, a cleaning routine that dispenses a cleaning liquid through the formulation dispensing assembly. For example, the formulation delivery device authenticates a cleaning cartridge inserted into the reusable handle, and then, in response to pressing a button on the reusable handle, executes a cleaning routine which causes peristaltic pump 410 to continuously or continually dispense a cleaning liquid (e.g., water) from the reciprocating nozzle assembly at one or more of the following predetermined device operating parameters for as long as the button is depressed: a cleaning liquid flow rate, a reciprocating frequency, or a reciprocating amplitude. In some embodiments, the cleaning liquid flow rate is higher than any formulation flow rate of one or more of the formulation routines stored in the controller 412, for the advantage of effectively flushing residual formulation from the formulation dispensing assembly.

In some embodiments, controller 412 also comprises logic, which when executed, causes the formulation delivery device to deliver one or more micro pulses to a motor of the peristaltic pump 410. In one aspect, disclosed herein is a non-transitory computer readable storage medium storing instructions that, when executed by one or more computers, cause the one or more computers (for example, the controller 412) to set a timer for a predetermined rest time after the peristaltic pump 410 is used, transmit a micro pulse to a motor of the peristaltic pump after the predetermined rest time has elapsed, and shift a motor roller from an initial position to a second position so that a pinch point of a tube of the peristaltic pump is formed in the second position, as shown in detail in FIGS. 2A-2B. In some embodiments, the instructions are further configured to set a second timer for a rotation time, transmit a second micro pulse to the motor after the rotation time has elapsed, and shift the motor roller from the second position to a third position so that a pinch point of the tube of the peristaltic pump is formed in the third position. In some embodiments, the instructions are further configured to reset the second timer a predetermined number of times, transmit a micro pulse of a plurality of micro pulses to the motor each time the rotation time elapses, and shift the motor roller from the third position to a new position so that a pinch point of the tube of the peristaltic pump is formed in the new position each time the micro pulse of the plurality of micro pulses is received by the motor.

Pull through adaptor 404 attaches to the reusable handle 406 over the reciprocating nozzle assembly 414. In some embodiments, pull through adaptor 404 provides an audible feedback signal upon correct engagement with the reusable handle 406.

Figure 2A:
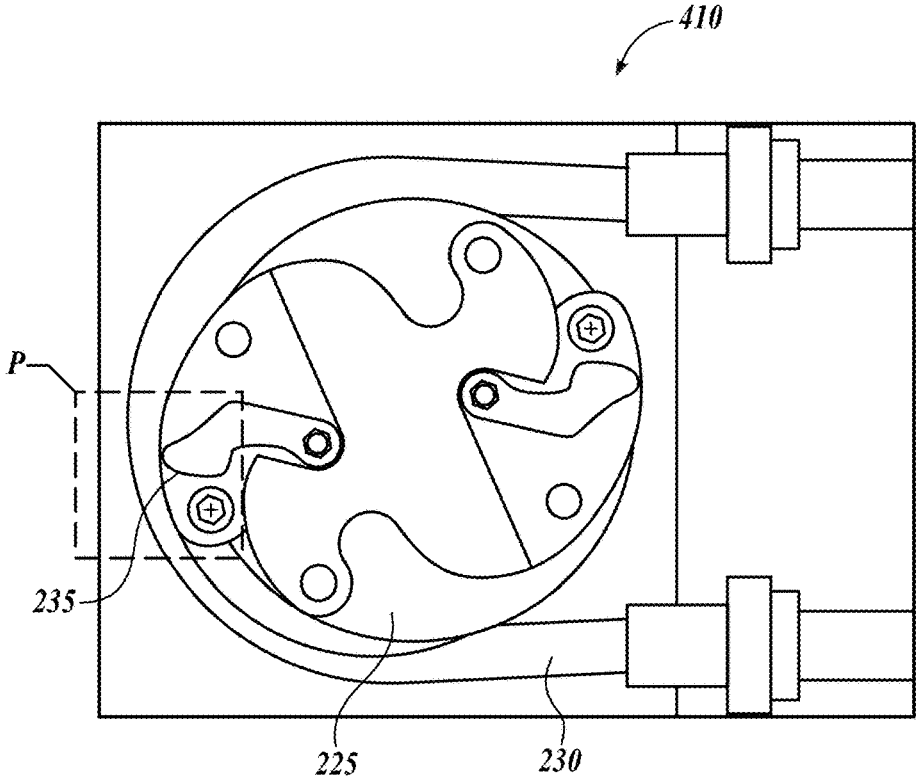
FIGS. 2A-2B are example peristaltic pumps performing a method of prolonging the life of a peristaltic pump, in accordance with the present technology.
Figure 2B:
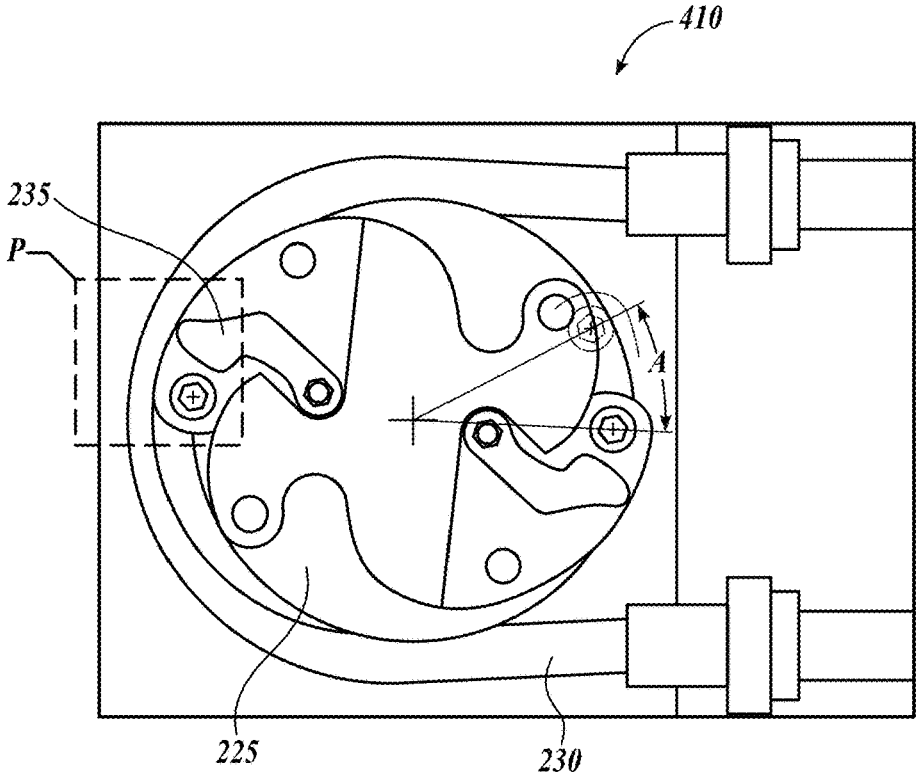

FIGS. 2A-2B are example peristaltic pumps 410 performing a method of prolonging the life of a peristaltic pump 410, in accordance with the present technology. In some embodiments, the peristaltic pump 410 includes a motor 225, a formula delivery tube 230, and a motor roller 235.

In operation, formula flows from one end of the formula delivery tube 230 to the other end, to eventually be dispensed by a device. In some embodiments, the peristaltic pump includes one or more motor rollers 235 configured to pinch the formula delivery tube 230 at pinch point P when the device is not in use to prevent leakage, dripping, or the like. In some embodiments, the motor roller 235 pinches the formula delivery tube 230 while the device is stored. As explained herein, constant compression of the formula delivery tube 230 in peristaltic pumps can lead to excessive creep, particularly in silicone tubing, which can lead to permanent deformation or fusing of the inner diameter of the tubing.

In order to minimize, or even eliminate creep, a method has been developed to reduce the time a particular area of the formula delivery tube 230 is under compression. In some embodiments, micro-pulses are transmitted to the motor 225 to incrementally change the location of the pinch point P so that the relaxation period of the formula delivery tube 230 is maximized thereby reducing creep and avoid tube fusing.

In operation, a timer may be set for a predetermined rest time after the peristaltic pump 410 is used. After the predetermined rest time has elapsed, a micro pulse may be transmitted to a motor 225 of the peristaltic pump 410. In response to the micro pulse, the motor roller 235 shifts from an initial position (P in FIG. 2A) to a second position (P in FIG. 2B) so that a pinch point P of the formula delivery tube 230 (or "tube") of the peristaltic pump 410 is formed in the second position (as shown in FIG. 2B).

In some embodiments, the predetermined rest time is about 12 hours. This is because it is likely that a user of a device containing the peristaltic pump 410 (such as device 100) will use the device during the day. By setting the time for 12 hours, the motor roller 235 may shift at night, when it is less likely that the user will use the device.

In some embodiments, the second position (P in FIG. 2B) is offset at an angle A relative to the initial position (P in FIG. 2A). In some embodiments, the angle is about 30 degrees.

In some embodiments, micro pulses are transmitted to the motor 225 of the peristaltic pump 410 every time a second timer finishes. In some embodiments, the second timer is set for a rotation time. In some embodiments, the rotation time is 24 hours. In some embodiments, the 24 hour rotation time ensures that the motor roller 235 is shifted at night. In this manner, the pinch point P may be moved multiple times when the device is not in use, to further avoid creep and tube fusing. In such embodiments, the method further includes resetting the second timer a predetermined number of times, transmitting a micro pulse of a plurality of micro pulses to the motor 225 each time the rotation time elapses, and shifting the motor roller 235 to a new position so that a pinch point P of the formula delivery tube 230 of the peristaltic pump 410 is formed in the new position each time the micro pulse of the plurality of micro pulses is received by the motor 225.

In some embodiments, only a single additional micro pulse may be transmitted to the motor 225. In some embodiments, the method includes setting a second timer for a rotation time, after the rotation time has elapsed, transmitting a second micro pulse to the motor, and shifting the motor roller from the second position to a third position so that a pinch point of the tube of the peristaltic pump is formed in the third position. In other embodiments, a first micro pulse may move the pinch point from the initial position to the second position and a second micro pulse may move the pinch point from the second position to the initial position. In this manner the initial position and the second position may be alternated each time a micro pulse is transmitted to the motor 225, In some embodiments, the third position is offset at an angle A relative to the second position. In some embodiments, the angle A is about 30 degrees.

In some embodiments, the second timer is reset a predetermined number of times, a micro pulse of a plurality of micro pulses to the motor is transmitted each time the rotation time elapses, and the motor roller is shifted from the third position to a new position so that a pinch point of the tube of the peristaltic pump is formed in the new position each time the micro pulse of the plurality of micro pulses is received by the motor.

In some embodiments, the peristaltic pump is integrated into a device (such as device 100). In some embodiments, the micro pulse is transmitted by a controller (such as controller 412) of the device.

Figure 3:
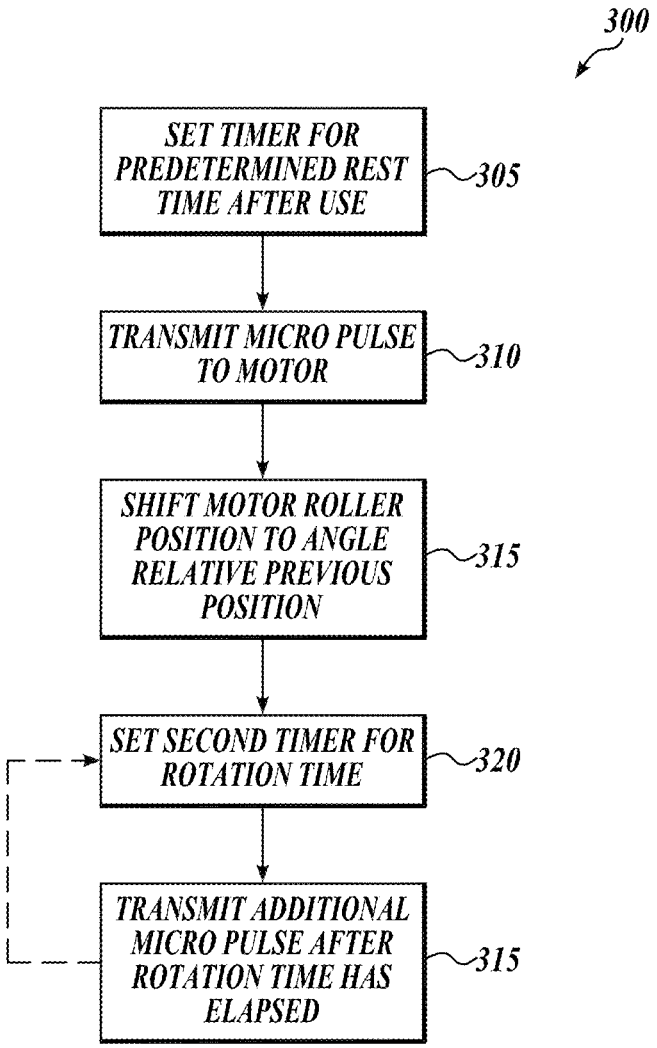
FIG. 3 is an example method of prolonging the life of a peristaltic pump, in accordance with the present technology.

FIG. 3 is an example method 300 of prolonging the life of a peristaltic pump, in accordance with the present technology. In some embodiments, the method 300 is carried out with the peristaltic pump (such as peristaltic pump 410) of FIGS. 2A-2B. In some embodiments, the peristatic pump includes a motor (such as motor 225), a tube (such as formula delivery tube 230), and a motor roller (such as motor roller 235). In some embodiments, the peristaltic device is integrated into a device (such as device 100) having a controller (such as controller 412).

In block 305, a timer is set for a predetermined rest time. In some embodiments, the timer is set after a user uses a device. In some embodiments, the predetermined rest time is 12 hours. In some embodiments, this ensures that a micro pulse is sent to the motor of the peristaltic pump (as explained in block 310) is transmitted to the motor at night, and thus does not disrupt a user or use of the device.

In block 310, a micro pulse is transmitted to the motor. In some embodiments, the micro pulse is transmitted by the controller of the device.

In block 315, a position of the motor roller of the peristatic pump is shifted to an angle (such as angle A of FIGS. 2A-2B) relative to the previous position. In some embodiments, the angle is about 30 degrees. In this manner, the method prolongs the life of the peristaltic pump by reducing and/or preventing creep and/or tube fusing of the tube of the peristaltic pump.

In block 320, a second timer for rotation time is set. In some embodiments, the rotation time is 24 hours. In such embodiments, after the first time is set for 12 hours, by setting the second timer for every 24 hours, the micro pulses (as explained in block 315) may be transmitted to the motor at night, and thus does not disrupt a user or use of the device.

In block 315, an additional micro pulse is transmitted to the motor after the rotation time has elapsed. Optionally, the method may return to block 320 any number of times, such as for as long as the device is not used. In some embodiments, the motor roller may shift between six or more positions along the tube of the peristaltic pump, so that no one position on the tube experiences creep or fusing. In some embodiments, the motor roller may alternate between two or three positions.

It should be understood that method 300 should be interpreted as merely representative. In some embodiments, process blocks of method 300 may be performed simultaneously, sequentially, in a different order, or even omitted, without departing from the scope of this disclosure The present application may reference quantities and numbers. Unless specifically stated, such quantities and numbers are not to be considered restrictive, but representative of the possible quantities or numbers associated with the present application. Also, in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

Embodiments disclosed herein may utilize circuitry in order to implement technologies and methodologies described herein, operatively connect two or more components, generate information, determine operation conditions, control an appliance, device, or method, and/or the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof.

An embodiment includes one or more data stores that, for example, store instructions or data. Non-limiting examples of one or more data stores include volatile memory (e.g., Random Access memory (RAM), Dynamic Random Access memory (DRAM), or the like), non-volatile memory (e.g., Read-Only memory (ROM), Electrically Erasable Programmable Read-Only memory (EEPROM), Compact Disc Read-Only memory (CD-ROM), or the like), persistent memory, or the like. Further non-limiting examples of one or more data stores include Erasable Programmable Read-Only memory (EPROM), flash memory, or the like. The one or more data stores can be connected to, for example, one or more computing devices by one or more instructions, data, or power buses.

In an embodiment, circuitry includes a computer-readable media drive or memory slot configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as any form of flash memory, magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

While illustrative embodiments have been illustrated and described, it will be appreciated that various changes can be made therein without departing from the spirit and scope of the invention.

We claim:

1. A method of prolonging the life of a peristaltic pump, the method comprising:

setting a timer for a predetermined rest time;

transmitting a micro pulse to a motor of the peristaltic pump after the predetermined rest time has elapsed; and shifting a motor roller from an initial position to a second position so that a pinch point of a tube of the peristaltic pump is formed in the second position.

2. The method of claim 1, wherein the predetermined rest time is about 12 hours.

3. The method of claim 1, wherein the second position is offset at an angle relative to the initial position.

4. The method of claim 3, wherein the angle is about 30 degrees.

5. The method of claim 1, wherein the method further comprises:

resetting a second timer for a rotation time a predetermined number of times;

transmitting a micro pulse of a plurality of micro pulses to the motor each time the rotation time elapses; and shifting the motor roller to a new position so that a pinch point of the tube of the peristaltic pump is formed in the new position each time the micro pulse of the plurality of micro pulses is received by the motor.

6. The method of claim 1, wherein the method further comprises:

setting a second timer for a rotation time;

after the rotation time has elapsed, transmitting a second micro pulse to the motor; and shifting the motor roller from the second position to a third position so that a pinch point of the tube of the peristaltic pump is formed in the third position.

7. The method of claim 6, wherein the third position is offset at an angle relative to the second position.

8. The method of claim 7, wherein the angle is about 30 degrees.

9. The method of claim 6, wherein the method further comprises:

resetting the second timer a predetermined number of times;

transmitting a micro pulse of a plurality of micro pulses to the motor each time the rotation time elapses; and shifting the motor roller from the third position to a new position so that a pinch point of the tube of the peristaltic pump is formed in the new position each time the micro pulse of the plurality of micro pulses is received by the motor.

10. The method of claim 1, wherein the peristaltic pump is integrated into a device.

11. The method of claim 1, wherein the micro pulse is transmitted by a controller of the device.

12. A non-transitory computer readable storage medium storing instructions that, when executed by one or more computers, cause the one or more computers to:

set a timer for a predetermined rest time;

transmit a micro pulse to a motor of the peristaltic pump after the predetermined rest time has elapsed; and shift a motor roller from an initial position to a second position so that a pinch point of a tube of the peristaltic pump is formed in the second position.

13. The non-transitory computer readable storage medium of claim 12, wherein the predetermined rest time is about 12 hours.

14. The non-transitory computer readable storage medium of claim 12, wherein the second position is offset at an angle relative to the initial position.

15. The non-transitory computer readable storage medium of claim 14, wherein the angle is about 30 degrees.

16. The non-transitory computer readable storage medium of claim 12, wherein the instructions are further configured to:

set a second timer for a rotation time;

transmit a second micro pulse to the motor after the rotation time has elapsed; and shift the motor roller from the second position to a third position so that a pinch point of the tube of the peristaltic pump is formed in the third position.

17. The non-transitory computer readable storage medium of claim 16, wherein the third position is offset at an angle relative to the second position.

18. The non-transitory computer readable storage medium of claim 16, wherein the angle is about 30 degrees.

19. The non-transitory computer readable storage medium of claim 16, wherein the instructions are further configured to:

reset the second timer a predetermined number of times;

transmit a micro pulse of a plurality of micro pulses to the motor each time the rotation time elapses; and shift the motor roller from the third position to a new position so that a pinch point of the tube of the peristaltic pump is formed in the new position each time the micro pulse of the plurality of micro pulses is received by the motor.

20. The non-transitory computer readable storage medium of claim 12, wherein the peristaltic pump is integrated into a device, and wherein the micro pulse is transmitted by a controller of the device.

* * * * *